US005901888A

United States Patent [19]

Schneider et al.

[11] Patent Number: 5,901,888

[45] Date of Patent: May 11, 1999

[54] DEVICE, METHOD, AND SYSTEM FOR CLOTHING ORGANIZATION

[75] Inventors: Boris Schneider, Wyomissing Hills; Dean Sheaffer, Reading, both of Pa.

[73] Assignee: Brainy Ideas, Inc., Reading, Pa.

[21] Appl. No.: 09/149,070

[22] Filed: Sep. 8, 1998

Related U.S. Application Data

[ 60] Provisional application No. 60/088,181, Jun. 5, 1998.

[51] Int. Cl.[6] ..... A47G 25/18

[52] U.S. Cl. ..... 223/89; 223/DIG. 1; 223/94; 223/88

[58] Field of Search ..... 223/94, 89, 88, 223/DIG. 1, 85; 211/113

[56] References Cited

U.S. PATENT DOCUMENTS

| | | | |
|---|---|---|---|
| 1,743,234 | 1/1930 | Porter . | |
| 1,937,911 | 12/1933 | Pajeau . | |
| 2,233,439 | 3/1941 | Lion | 223/94 |
| 2,459,417 | 1/1949 | Dodge | 223/DIG. 1 |
| 2,605,942 | 8/1952 | Warren et al. | 223/89 |
| 3,017,059 | 1/1962 | Dzienisiewicz . | |
| 3,179,256 | 4/1965 | Underwood . | |
| 3,485,423 | 12/1969 | Wagar et al. | 223/85 |
| 3,531,028 | 9/1970 | Vazquez | 223/94 |
| 3,592,343 | 7/1971 | Swett | 223/88 |
| 3,783,995 | 1/1974 | Tobin | 223/DIG. 1 |
| 4,117,960 | 10/1978 | Bengsch et al. | 223/94 |
| 4,227,632 | 10/1980 | Collis | 223/94 |
| 4,416,401 | 11/1983 | King | 223/88 |
| 4,730,737 | 3/1988 | Robinson . | |
| 4,813,581 | 3/1989 | LaMont | 223/94 |
| 4,871,098 | 10/1989 | Bredeweg et al. | 223/85 |
| 4,953,717 | 9/1990 | Rosch . | |
| 5,052,599 | 10/1991 | Platti . | |
| 5,145,098 | 9/1992 | Tung . | |
| 5,405,065 | 4/1995 | Olson | 223/85 |
| 5,480,076 | 1/1996 | Siegel et al. | 223/94 |
| 5,664,708 | 9/1997 | Sacks | 223/DIG. 1 |

FOREIGN PATENT DOCUMENTS

| | | | |
|---|---|---|---|
| 1138536 | 6/1957 | France . | |
| 1342005 | 2/1964 | France . | |
| 33 35 939 | 4/1985 | Germany | A47G 25/04 |
| 89 01 186 | 7/1989 | Germany | A47G 25/18 |
| 649207 | 5/1985 | Switzerland | A47G 25/40 |
| 320000 | 10/1929 | United Kingdom . | |
| 328828 | 5/1930 | United Kingdom . | |
| 354526 | 8/1931 | United Kingdom . | |
| 759905 | 10/1956 | United Kingdom . | |
| WO 80/0004 | 1/1980 | WIPO | A47J 51/10 |
| WO 90/09130 | 8/1990 | WIPO | A47G 25/18 |
| WO 91/03197 | 3/1991 | WIPO | A47G 25/40 |
| WO 96/39069 | 12/1996 | WIPO | A47G 25/40 |

OTHER PUBLICATIONS

1998 Advertisement. The Media Group, Inc. *The Closet Butler—Space Saving Storage System.*

Advertisement. VIDCOM Marketing A/S. *Flip—The Smart Space–Saving & Folding Hanger*, 2 pp.

*Primary Examiner*—Bibhu Mohanty

*Attorney, Agent, or Firm*—George T. Marcou; Kilpatrick Stockton LLP

[57] ABSTRACT

The invention includes a device, method, and system for clothing organization that includes a hanging structure, such as a large hook, attached to a hanger body, arms attached to the hanger body that can be unlatched and swung to a horizontal position, and a latching system to hold the arms in place. Several conventional hangers can be attached on each arm, allowing clothing to be hung by hangers on the device in an organized fashion, such as by outfits. In addition, the invention provides for vertical positioning of the arms with conventional hangers hung on the arms, which allows a compression of the clothing on the conventional hangers and efficient space saving. The hanger body of the invention also includes attached c-shaped accessory holders that allow easy organization and retrieving of accessories.

66 Claims, 1 Drawing Sheet

DEVICE, METHOD, AND SYSTEM FOR CLOTHING ORGANIZATION

This Provisional application claims priority to applicant's copending application titled DEVICE AND METHOD FOR CLOTHING ORGANIZATION having U.S. Ser. No. 60/088,181 filed Jun. 5, 1998.

FIELD OF THE INVENTION

The present invention relates to a hanger having pivotable arms, and in particular to a hanger having a hook for hanging the hanger on a hanger rod; arms pivotable to a latched upper position and a lower position, the arms for hanging conventional hangers in the lower position; latch releases having release tabs; accessory holders for holding accessories on the hanger; and an attachment point for joining hangers together into a chain.

BACKGROUND

Most clothing organization systems poorly utilize all available space. The typical "bar and hanger" system requires hangers to be spaced horizontally, leaving sufficient space between hangers to accommodate clothing or accessory items. This typically does not allow for effective use of vertical or horizontal space within the closet or other storage space. In addition, most clothing organization systems do not allow for the "compression" of clothing.

More advanced clothing organization systems typically cause the user difficulty in storing and retrieving items. Typically the clothing items must be rearranged in some manner to facilitate storage and retrieval of some or all items.

Further, clothing storage systems are not generally designed so that entire "outfits" of clothing can be stored together. This causes the user to have to search through multiple hangers to retrieve all clothing and accessories to complete their "outfit".

The prior art on hanging devices includes several patents. U.S. Pat. No. 1,743,234 to Porter includes a clothes hanger (FIG. 3) with horizontal arms that are downwardly pivotable into an extended horizontal position. The arms are located below a hook. The arms also include notches for receiving shoulder straps of women's gowns. The device of Porter does not include a hanger having a plurality of hang locations, such as holes, for fixedly holding conventional hangers, accessory holders, or an attachment point for chaining together hangers; in addition, the device of Porter does not allow clothing on the arms to be compressed by pivoting the arms upward.

U.S. Pat. No. 1,937,911 to Pajeau provides a necktie holder having arms that pivot downward to an extended position. The arms are physically configured such that garments can only be draped over the arms as extended. The device of Pajeau does not include a hanger having a plurality of hang locations, such as holes, for fixedly holding conventional hangers, accessory holders, or an attachment point for chaining together hangers; in addition, the device of Pajeau does not allow clothing on the arms to be compressed by pivoting the arms upward.

U.S. Pat. No. 4,730,737 to Robinson shows a clothes hanger having a hook, a pair of arms upwardly pivotable into an extended position, and a latch mechanism to secure the arms in a horizontal extended position. The arms are configured as elongated parallelepipeds having top, bottom, and side walls. The bottom wall has an elongated slot, wherein modified conventional hangers extend down through the slot. The hangers have been modified by having the conventional hanger hook replaced with a sphere, which is in turn retained inside of the arm. The device of Robinson does not include a hanger having a plurality of hang locations, such as holes, for fixedly holding conventional hangers, accessory holders, or an attachment point for chaining together hangers; in addition, the device of Robinson does not allow clothing on the arms to be compressed by pivoting the arms upward.

U.S. Pat. No. 5,405,065 to Olson includes a hanger having a center support member and a base having a plurality of arms being pivotally coupled thereto. The arms pivot downward to an extended horizontal position. The device of Olson does not include a hanger having a plurality of hang locations, such as holes, for fixedly holding conventional hangers, accessory holders, or an attachment point for chaining together hangers; in addition, the device of Olson does not allow clothing on the arms to be compressed by pivoting the arms upward.

It thus appears that there is a need for a clothing device, method, and system for clothing organization that overcomes the problems of the prior art. These problems include poor utilization of vertical and horizontal space in closets, lack of use of compression of clothing, difficulties with retrieving stored clothing, and failure to facilitate organized storage of clothing, such as in groups or outfits, using a hanger having a plurality of hang locations, such as holes, for fixedly holding conventional hangers, accessory holders, an attachment point for chaining together hangers, or a method and system to allow clothing on the arms to be compressed by pivoting the arms upward.

SUMMARY OF THE INVENTION

It is object of the invention to overcome the limitations of the prior art by providing a device, method, and system for a hanger for best utilizing available closet space. It is a further object of the present invention to provide a hanger that improves utilization of storage space both horizontally and vertically.

It is a further object of the present invention to provide for a hanger allowing compression of clothing to further improve utilization of storage space.

It is a further object of the invention to provide a hanger that facilitates the ordered storage and retrieval of clothing, including storage and retrieval of outfits.

To meet these objects, an embodiment of the present invention comprises a device, method, and system for clothing organization that includes a hanger having a hanging structure, such as a large hook, attached to a hanger body, arms attached to the hanger body that can be released and swung to a horizontal position, and a securing or latching system to hold the arms in place. In an embodiment of the present invention, several conventional hangers can be attached on each arm, allowing clothing to be hung by hangers on the device in an organized fashion, such as by outfits. In addition, an embodiment of the present invention provides for vertical positioning of the arms with conventional hangers hung on the arms, which allows compression of the clothing on the conventional hangers and efficient space saving. The hanger body of the hanger of an embodiment of the present invention also includes attached accessory holders that allow easy organization and retrieving of accessories.

To achieve the stated and other features, advantages, and objects of the present invention, an embodiment of the invention provides a hanger, comprising a hanger body having an attached hanging structure; a plurality of arms attached to the body; and a plurality of securing mechanisms for securing the plurality of arms in a first position relative to the hanger body; wherein the plurality of arms are each moveable from the first position to a second position such that the arms are fixably stopped in the second position and wherein each of the plurality of arms includes a plurality of hang locations for fixedly holding conventional hangers.

To achieve the stated and other features, advantages, and objects of the present invention, an embodiment of the invention provides a hanger, comprising a hanger body having an attached hanging structure; a plurality of arms attached to the body; a plurality of securing mechanisms for securing the plurality of arms in a first position relative to the hanger body; and at least one accessory holder attachable to the hanger; wherein the plurality of arms are each moveable from the first position to a second position such that the arms are fixably stopped in the second position.

To achieve the stated and other features, advantages, and objects of the present invention, an embodiment of the invention provides a hanger, comprising: a hanger body having an attached hanging structure; a plurality of arms attached to the body; a plurality of securing mechanisms for securing the plurality of arms in a first position relative to the hanger body; and at least one attachment point for attaching a second hanger to the hanger such that a plurality of hangers is formable into a chain of hangers; wherein the plurality of arms are each moveable from the first position to a second position such that the arms are fixably stopped in the second position.

To achieve the stated and other features, advantages, and objects of the present invention, an embodiment of the invention provides a hanger, comprising a hanger body having an attached hanging structure; a plurality of arms attached to the body; and a plurality of securing mechanisms for securing the plurality of arms in a first position relative to the hanger body; wherein the plurality of arms are each moveable from the first position to a second position such that the arms are fixably stopped in the second position, wherein at least one conventional hanger is hangable on each of the plurality of arms when in the second position, and wherein each of the plurality of arms having at least one conventional hanger hanging on the arm is pivotable to the first position.

To achieve the stated and other features, advantages, and objects of the present invention, an embodiment of the invention provides a method of hanging clothes on a hanger having a hanger body having an attached hanging structure; a plurality of arms attached to the body; and a plurality of securing mechanisms for securing the plurality of arms in a first position relative to the hanger body, the plurality of arms having a secured and an unsecured position; wherein the plurality of arms are each movable from the first position to a second position such that the arms are fixably stopped in the second position, comprising hanging at least one conventional hanger on at least one arm while the arm is in the second position; pivoting the at least one arm upon which hangs at least one conventional hanger from the second position to the first position; and latching the at least one arm upon which hangs at least one conventional hanger in the first position.

To achieve the stated and other features, advantages, and objects of the present invention, an embodiment of the invention provides a system for clothing organization, comprising at least two hangers, each hanger comprising a hanger body having an attached hanging structure; a plurality of arms attached to the body; and a plurality of securing mechanisms for securing the plurality of arms in a first position relative to the hanger body; and at least one attachment point for attaching a second hanger to the hanger such that a plurality of hangers is formable into a chain of hangers; wherein the plurality of arms are each moveable from the first position to a second position such that the arms are fixably stopped in the second position; wherein the at least two hangers includes at least a first hanger and at least a second hanger, the first hanger hangable from a hanger holder and the second hanger hangable to the first hanger at the at least one attachment point, such that a chain of hangers forms.

Additional objects, advantages and novel features of the invention will be set forth in part in the description that follows, and in part will become more apparent to those skilled in that upon examination of the following; these features may also be learned by practice of the invention.

DETAILED DESCRIPTION

Figure 1:
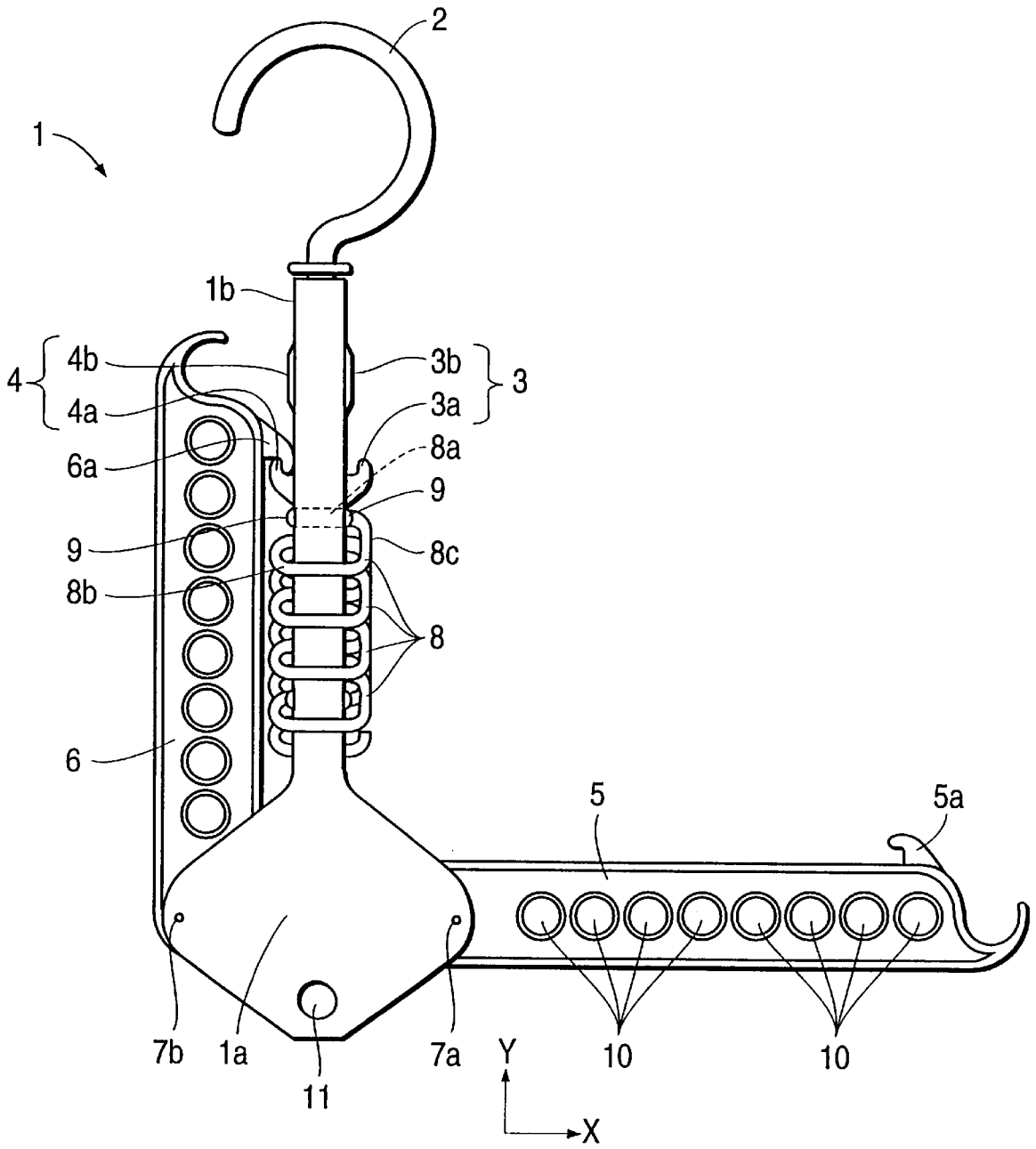
FIG. 1 presents a side view of the hanger according to an embodiment of the present invention.

An embodiment of the present invention, which is referred to as the Hook 'N' Hang clothing organization device, method, and system, is comprised of a hanger having a number of elements as illustrated in FIG. 1. The main component 1*a* or "body" of the hanger 1 is hollow to allow insertion of other components. The body 1*a* has a narrow top 1*b* into which a hanging structure 2, such as a large hook, is inserted in such a manner that the body 1*a* may rotate 360 degrees while the hook 2 remains in a fixed position.

In an embodiment of the present invention, as shown in FIG. 1, two securing mechanisms 3, 4, such as latches, are incorporated near the top of the body 1*a*. As shown in FIG. 1, one securing mechanism 3 secures the right "arm" 5 of the system, and the other securing mechanism 4 secures the left arm 6. The securing mechanisms 3, 4 operate independently. In an embodiment of the present invention, each mechanism 3, 4 includes a body latch tab 3*a*, 4*a*, and a slide button for lock and release 3*b*, 4*b*. By pressing downward on the release buttons 3*b*, 4*b* of the latching mechanisms 3, 4 of this embodiment, the body latch tabs 3*a*, 4*a* are moved downward, causing the latching mechanisms 3, 4 to disengage from the arm latch tabs 5*a*, 6*a*, respectively, and thus allowing the arms 5, 6 to swing downward as shown in FIG. 1. The latching mechanisms 3,4 return to their most upward position as shown in FIG. 1 through the use of a spring mechanism (not shown), which, in this embodiment, is located inside the body 1*a*, upon release of the arms 5, 6.

The body 1*a* and arm latching tabs 5*a*, 6*a* are designed in this embodiment in such a manner that when each arm 5, 6 is located in a first position, its upright position, as shown in FIG. 1, and pressure is applied on the latching tabs 5*a*, 6*a* in the direction of the body 1*a*, each latching mechanism 3, 4 is moved downward, as shown in FIG. 1, until each arm latching tab 5*a*, 6*a* clears the body latching tab 3*a*, 4*a*. The spring mechanism (not shown) then moves the latching mechanism 3, 4 upward, as shown in FIG. 1, engaging the latching mechanism 3, 4 and thus securing each arm 5, 6 in its upright position, as shown in FIG. 1.

In an embodiment of the present invention, the arms 5, 6 are attached to the body 1*a* each by means of a pivot element 7*a*, 7*b* inserted through both the body 1*a* and each arm 5, 6. Each arm 5, 6 extends past the pivot element 7*a*, 7*b* into the body 1*a*. When moved to a second position, its most downward position, as shown in FIG. 1, the portion of the arm (not shown) within the body 1*a* a that extends beyond the pivot point 7*a*, 7*b* contacts a "stop" (not shown) that limits the downward movement of the arm 5, 6, as shown in FIG. 1.

In an embodiment of the present invention, the arms 5, 6, when in the released position (position of arm 5, as shown in FIG. 1), rest at approximately a 3° to 5° angle Φ above an axis x perpendicular to the axis y of the body 1*a* of the hanger 1 (i.e., an angle Φ that is approximately 3° to 5° above the horizontal as shown in FIG. 1.) This slight incline of the arms 5, 6 in the release position provides better support.

An embodiment of the present invention includes accessory holders 8. In an embodiment of the present invention, these accessory holders 8 are "squared-C" shaped units, each having two horizontal elements 8*a*, 8*b* and one vertical element 8*c*. The upper horizontal element 8*a* is placed through the body 1*a* in and secured by "cuffs" 9 extending on either side of the body 1*a*. The accessory holders 8 are rotatable outward, as shown in FIG. 1, from the body 1*a* of the hanger 1.

Accessories such as belts, ties, scarves, etc. may be hung from the accessory hangers 8. Thus the user can store entire "outfits" of clothing together. For example one could store multiple suits along with their matching shirts, ties and belts on the same "Hook 'N' Hang" for convenience. This solves the problem of having to search through and retrieve clothing and accessories from multiple hangers to complete the user's "outfit".

In using an embodiment of the present invention, as shown in FIG. 1, clothes are first placed on conventional hangers (not shown). The arms 5, 6 have a number of hang locations 10, such as holes through which any conventional hanger may be inserted. Conventional hangers are then placed at the hang locations, such as through the holes 10 in the arms 5, 6 of the "Hook 'N' Hang" system 1, while the arms 5, 6 are in their downward position, as shown in FIG. 1. (Accessories and conventional hangers can also be placed on the system 1 while the arms are in the upright position, as shown in FIG. 1.) The arms 5, 6 are then raised and locked in their upright positions, as shown in FIG. 1, "compressing" the clothes.

Multiple "Hook 'N' Hang" systems may be placed on the same hanging bar, as in a closet (not shown), in close proximity to one another. This is the "normal" storage configuration for the hanger according to an embodiment of the present invention. In this normal position, the hanging structure 2 is rotated 90 degrees from its position as shown in FIG. 1, such that the hangers of the present invention hang parallel to each other on the bar. When the user desires to retrieve clothing, the body 1*a* is rotated 90 degrees from its normal position, to the position shown in FIG. 1. One arm 5 or 6 may then be released, so that it swings outward from the bar (not shown) and the desired item (not shown) may then be retrieved. This solves the problem of compressing clothes to fully utilize horizontal space while ensuring that items can be stored and retrieved easily.

In an embodiment of the present invention, at the bottom of the body 1*a* is an attachment point 11, such as a hole through which, for example, the hook of a second "Hook 'N' Hanger" (not shown) may be placed. Multiple "Hook 'N' Hang" systems 1 are thus "chainable" together by inserting the hook of the lower system (not shown) through the hole 11 in the body of the upper hanger 1. Any number of systems may be chained in this manner to solve the problem of fully utilizing vertical space.

Embodiments of the present invention have now been described in fulfillment of the above objects. It will be appreciated that these examples are merely illustrative of the invention. Many variations and modifications will be apparent to those skilled in the art.

We claim:

1. A hanger, comprising:

a hanger body having an attached hanging structure;

a plurality of arms attached to the body; and at least one securing mechanism for securing the plurality of arms in a first position relative to the hanger body;

wherein the plurality of arms are each moveable from the first position to a second position, such that the arms are fixably stopped in the second position, wherein each of the plurality of arms includes a plurality of hang locations for fixedly holding conventional hangers, and wherein the hang locations comprise holes in the plurality of arms.

2. A hanger, comprising:

a hanger body having an attached hanging structure;

a plurality of arms attached to the body; and at least one securing mechanism for securing the plurality of arms in a first position relative to the hanger body, wherein the at least one securing mechanism includes a latch tab and a slide button, such that the at least one securing mechanism is releasable by sliding the slide button;

wherein the plurality of arms are each moveable from the first position to a second position, such that the arms are fixably stopped in the second position, and wherein each of the plurality of arms includes a plurality of hang locations for fixedly holding conventional hangers.

3. A hanger, comprising:

a hanger body having an attached hanging structure;

a plurality of arms attached to the body;

at least one securing mechanism for securing the plurality of arms in a first position relative to the hanger body, and at least one accessory holder attachable to the hanger, wherein at least one accessory holder comprises a C-shaped holder;

wherein the plurality of arms are each moveable from the first position to a second position, such that the arms are fixably stopped in the second position.

4. A hanger, comprising:

a hanger body having an attached hanging structure;

a plurality of arms attached to the body;

at least one securing mechanism for securing the plurality of arms in a first position relative to the hanger body; and means for retaining a conventional hanger at a fixed location during pivoting, upon the conventional hanger being hung on one of the plurality of arms;

wherein the plurality of arms are each moveable from the first position to a second position such that the arms are fixedly stopped in the second position, wherein at least one conventional hanger is hangable on each of the plurality of arms when in the second position, and wherein each of the plurality of arms having at least one conventional hanger hanging on the arm is pivotable to the first position.

5. A method of hanging clothes, comprising:

providing a hanger, the hanger including a hanger body having an attached hanging structure; a plurality of arms attached to the body; and a plurality of securing mechanisms for securing the plurality of arms in a first position relative to the hanger body, the plurality of arms having a secured and an unsecured position; wherein the plurality of arms are each movable from the first position to a second position such that the arms are fixably stopped in the second position;

hanging at least one conventional hanger on at least one arm while the arm is in the second position;

pivoting the at least one arm upon which hangs at least one conventional hanger from the second position to the first position; and latching the at least one arm upon which hangs at least one conventional hanger in the first position.

6. The method of claim 5 wherein the hanger includes at least one accessory holder further comprising attaching at least one accessory to at least one accessory holder.

7. The method of claim 6 wherein the at least one accessory comprises a tie.

8. The method of claim 5 wherein the hanger is hangable on a hanger rod having a hanger rod axis, wherein the hanger body has a hanger body axis, wherein the attached hanging structure is rotatable about a hanging structure axis of rotation, the hanging structure axis of rotation being parallel to the hanger body axis, and wherein the plurality of arms lie in an arm plane, comprising:

hanging the hanger on the hanger rod by the hanging structure; and rotating the body of the hanger such that arm plane is perpendicular to the hanger rod axis.

9. The method of claim 5 further comprising:

hanging a plurality of conventional hangers on at least one arm, at least two of the plurality of conventional hangers each having a clothing item on the conventional hanger, such that the clothing items are groupable as in an outfit.

10. A hanger, comprising:

a hanger body having an attached hanging structure;

a plurality of arms attached to the body; and at least one securing mechanism for securing the plurality of arms in a first position relative to the hanger body; and at least one attachment point for attaching a second hanger to the hanger; such that a plurality of hangers is formable into a chain of hangers;

wherein the plurality of arms are each moveable from the first position to a second position, such that the arms are fixably stopped in the second position, wherein each of the plurality of arms includes a plurality of hang locations for fixedly holding conventional hangers, and wherein the hang locations comprise holes in the plurality of arms.

11. A hanger, comprising:

a hanger body having an attached hanging structure;

a plurality of arms attached to the body;

at least one securing mechanism for securing the plurality of arms in a first position relative to the hanger body;

at least one accessory holder attachable to the hanger;

at least one attachment point for attaching a second hanger to the hanger, such that a plurality of hangers is formable into a chain of hangers;

wherein the plurality of arms are each moveable from the first position to a second position, such that the arms are fixably stopped in the second position, wherein at least one accessory holder comprises a C-shaped holder.

12. A hanger, comprising:

a hanger body having an attached hanging structure;

a plurality of arms attached to the body;

at least one securing mechanism for securing the plurality of arms in a first position relative to the hanger body;

at least one attachment point for attaching a second hanger to the hanger, such that a plurality of hangers is formable into a chain of hangers; and at least one C-shaped accessory holder;

wherein the plurality of arms are each moveable from the first position to a second position, such that the arms are fixable stopped in the second position, wherein each of the plurality of arms includes a plurality of hang locations for fixedly holding conventional hangers, wherein the hanging structure comprises a hook, and wherein the plurality of arms include a plurality of hang locations, the plurality of hang locations comprising holes in the plurality of arms.

13. A hanger, comprising:

a hanger body having an attached hanging structure;

a plurality of arms attached to the body; and at least one securing mechanism for securing the plurality of arms in a first position relative to the hanger body;

wherein the plurality of arms are each moveable from the first position to a second position, such that the arms are fixably stopped in the second position, wherein each of the plurality of arms includes a plurality of hang locations for fixedly holding conventional hangers, wherein the plurality of arms are pivotally attached to the body, and wherein the plurality of arms include a plurality of hang locations, the plurality of hang locations comprising holes in the plurality of arms.

14. A hanger, comprising:

a hanger body having an attached hanging structure;

a plurality of arms attached to the body; and at least one securing mechanism for securing the plurality of arms in a first position relative to the hanger body;

wherein the plurality of arms are each moveable from the first position to a second position, such that the arms are fixably stopped in the second position, wherein each of the plurality of arms includes a plurality of hang locations for fixedly holding conventional hangers, wherein the plurality of arms are pivotally attached to the body, and wherein each hanger further comprises at least one C-shaped accessory holder.

15. A hanger, comprising:

a hanger body having an attached hanging structure;

a plurality of arms attached to the body;

at least one securing mechanism for securing the plurality of arms in a first position relative to the hanger body; and at least one attachment point for attaching a second hanger to the hanger, such that a plurality of hangers is formable into a chain of hangers;

wherein the plurality of arms are each moveable from the first position to a second position, such that the arms are fixably stopped in the second position, wherein each of the plurality of arms includes a plurality of hang locations for fixedly holding conventional hangers, wherein the plurality of arms are pivotally attached to the body, and wherein the plurality of arms include a plurality of hang locations, the plurality of hang locations comprising holes in the plurality of arms.

16. A hanger, comprising:

a hanger body having an attached hanging structure;

a plurality of arms attached to the body;

at least one securing mechanism for securing the plurality of arms in a first position relative to the hanger body; and at least one attachment point for attaching a second hanger to the hanger, such that a plurality of hangers is formable into a chain of hangers;

wherein the plurality of arms are each moveable from the first position to a second position, such that the arms are fixably stopped in the second position, wherein each of the plurality of arms includes a plurality of hang locations for fixedly holding conventional hangers, wherein the plurality of arms are pivotally attached to the body, and wherein each hanger further comprises at least one C-shaped accessory holder.

17. The hanger of claim 15, wherein each hanger further comprises at least one C-shaped accessory holder.

18. A hanger, comprising:

a hanger body having an attached hanging structure;

a plurality of arms attached to the body; and at least one securing mechanism for securing the plurality of arms in a first position relative to the hanger body;

wherein the plurality of arms are each moveable from the first position to a second position, such that the arms are fixably stopped in the second position, wherein each of the plurality of arms includes a plurality of hang locations for fixedly holding conventional hangers, wherein the hang locations comprise holes in the plurality of arms, and wherein each hanger further comprises at least one C-shaped accessory holder.

19. The hanger of claim 10, wherein each hanger further comprises at least one C-shaped accessory holder.

20. The hanger of claim 10, wherein the plurality of arms include a plurality of hang locations, the plurality of hang locations comprising holes in the plurality of arms, and wherein each hanger further comprises at least one C-shaped accessory holder.

21. A hangers, comprising:

a hanger body having an attached hanging structure;

a plurality of arms attached to the body; and at least one securing mechanism for securing the plurality of arms in a first position relative to the hanger body;

wherein the plurality of arms are each moveable from the first position to a second position, such that the arms are fixably stopped in the second position, wherein each of the plurality of arms includes a plurality of hang locations for fixedly holding conventional hangers, wherein each securing mechanism comprises a latch, and wherein the plurality of arms include a plurality of hang locations, the plurality of hang locations comprising holes in the plurality of arms.

22. A hanger, comprising:

a hanger body having an attached hanging structure;

a plurality of arms attached to the body; and at least one securing mechanism for securing the plurality of arms in a first position relative to the hanger body;

wherein the plurality of arms are each moveable from the first position to a second position, such that the arms are fixably stopped in the second position, wherein each of the plurality of arms includes a plurality of hang locations for fixedly holding conventional hangers, wherein each securing mechanism comprises a latch, and wherein each hanger further comprises at least one C-shaped accessory holder.

23. A hanger, comprising:

a hanger body having an attached hanging structure;

a plurality of arms attached to the body;

at least one securing mechanism for securing the plurality of arms in a first position relative to the hanger body; and at least one attachment point for attaching a second hanger to the hanger, such that a plurality of hangers is formable into a chain of hangers;

wherein the plurality of arms are each moveable from the first position to a second position, such that the arms are fixably stopped in the second position, wherein each of the plurality of arms includes a plurality of hang locations for fixedly holding conventional hangers, wherein each securing mechanism comprises a latch, and wherein the plurality of arms include a plurality of hang locations, the plurality of hang locations comprising holes in the plurality of arms.

24. A hanger, comprising:

a hanger body having an attached hanging structure;

a plurality of arms attached to the body;

at least one securing mechanism for securing the plurality of arms in a first position relative to the hanger body; and at least one attachment point for attaching a second hanger to the hanger, such that a plurality of hangers is formable into a chain of hangers;

wherein the plurality of arms are each moveable from the first position to a second position, such that the arms are fixably stopped in the second position, wherein each of the plurality of arms includes a plurality of hang locations for fixedly holding conventional hangers, wherein each securing mechanism comprises a latch, and wherein each hanger further comprises at least one C-shaped accessory holder.

25. The hanger of claim 23, wherein each hanger further comprises at least one C-shaped accessory holder.

26. A hanger, comprising:

a hanger body having an attached hanging structure;

a plurality of arms attached to the body; and at least one securing mechanism for securing the plurality of arms in a first position relative to the hanger body;

wherein the plurality of arms are each moveable from the first position to a second position, such that the arms are fixably stopped in the second position, wherein each of the plurality of arms includes a plurality of hang locations for fixedly holding conventional hangers, wherein each securing mechanism comprises a latch, wherein each latch has a latched position and an unlatched position, wherein each latch is biased in the latched position, and wherein the plurality of arms include a plurality of hang locations, the plurality of hang locations comprising holes in the plurality of arms.

27. A hanger, comprising:

a hanger body having an attached hanging structure;

a plurality of arms attached to the body;

at least one securing mechanism for securing the plurality of arms in a first position relative to the hanger body; and at least one C-shaped accessory holder;

wherein the plurality of arms are each moveable from the first position to a second position, such that the arms are fixably stopped in the second position, wherein each of the plurality of arms includes a plurality of hang locations for fixedly holding conventional hangers, wherein each securing mechanism comprises a latch, wherein each latch has a latched position and an unlatched position and wherein each latch is biased in the latched position.

28. A hanger, comprising:

a hanger body having an attached hanging structure;

a plurality of arms attached to the body;

at least one securing mechanism for securing the plurality of arms in a first position relative to the hanger body; and at least one attachment point for attaching a second hanger to the hanger, such that a plurality of hangers is formable into a chain of hangers;

wherein the plurality of arms are each moveable from the first position to a second position, such that the arms are fixably stopped in the second position, wherein each of the plurality of arms includes a plurality of hang locations for fixedly holding conventional hangers, wherein each latch has a latched position and an unlatched position, wherein each latch is biased in the latched position, and wherein the plurality of arms include a plurality of hang locations, the plurality of hang locations comprising holes in the plurality of arms.

29. A hanger, comprising:

a hanger body having an attached hanging structure;

a plurality of arms attached to the body;

at least one securing mechanism for securing the plurality of arms in a first position relative to the hanger body;

at least one attachment point for attaching a second hanger to the hanger, such that a plurality of hangers is formable into a chain of hangers; and at least one C-shaped accessory holder;

wherein the plurality of arms are each moveable from the first position to a second position, such that the arms are fixably stopped in the second position, wherein each of the plurality of alms includes a plurality of hang locations for fixedly holding conventional hangers, wherein each latch has a latched position and an unlatched position, and wherein each latch is biased in the latched position.

30. The hanger of claim 29, wherein each hanger further comprises at least one C-shaped accessory holder.

31. A hanger, comprising:

a hanger body having an attached hanging structure;

a plurality of arms attached to the body; and at least one securing mechanism for securing the plurality of arms in a first position relative to the hanger body;

wherein the plurality of arms are each moveable from the first position to a second position, such that the arms are fixably stopped in the second position, wherein each of the plurality of arms includes a plurality of hang locations for fixedly holding conventional hangers, wherein the hanger body has an axis, wherein the hook is rotatable about an axis of rotation, the axis of rotation being parallel to the axis of the hanger body, and wherein the plurality of arms include a plurality of hang locations, the plurality of hang locations comprising holes in the plurality of arms.

32. A hanger, comprising:

a hanger body having an attached hanging structure;

a plurality of arms attached to the body; and at least one securing mechanism for securing the plurality of arms in a first position relative to the hanger body;

wherein the plurality of arms are each moveable from the first position to a second position, such that the arms are fixable stopped in the second position, wherein each of the plurality of arms includes a plurality of hang locations for fixedly holding conventional hangers, wherein the hanger body has an axis, wherein the hook is rotatable about an axis of rotation, the axis of rotation being parallel to the axis of the hanger body, and wherein each hanger further comprises at least one C-shaped accessory holder.

33. A hangers, comprising:

a hanger body having an attached hanging structure;

a plurality of arms attached to the body;

at least one securing mechanism for securing the plurality of arms in a first position relative to the hanger body; and at least one attachment point for attaching a second hanger to the hanger, such that a plurality of hangers is formable into a chain of hangers;

wherein the plurality of arms are each moveable from the first position to a second position, such that the arms are fixably stopped in the second position, wherein each of the plurality of arms includes a plurality of hang locations for fixedly holding conventional hangers, wherein the hanger body has an axis, wherein the hook is rotatable about an axis of rotation, the axis of rotation being parallel to the axis of the hanger body, and wherein the plurality of arms include a plurality of hang locations, the plurality of hang locations comprising holes in the plurality of arms.

34. A hanger, comprising:

a hanger body having an attached hanging structure;

a plurality of arms attached to the body;

at least one securing mechanism for securing the plurality of arms in a first position relative to the hanger body;

at least one attachment point for attaching a second hanger to the hanger, such that a plurality of hangers is formable into a chain of hangers; and at least one C-shaped accessory holder;

wherein the plurality of arms are each moveable from the first position to a second position, such that the arms are fixably stopped in the second position, wherein each of the plurality of arms includes a plurality of hang locations for fixedly holding conventional hangers, wherein the hanger body has an axis, and wherein the hook is rotatable about an axis of rotation, the axis of rotation being parallel to the axis of the hanger body.

35. The hanger of claim 33, wherein each hanger further comprises at least one C-shaped accessory holder.

36. A hanger, comprising:

a hanger body having an attached hanging structure;

a plurality of arms attached to the body; and at least one securing mechanism for securing the plurality of arms in a first position relative to the hanger body;

wherein the plurality of arms are each moveable from the first position to a second position, such that the arms are fixably stopped in the second position, wherein each of the plurality of arms includes a plurality of hang locations for fixedly holding conventional hangers, wherein the hanger body has an axis, wherein the second position is about 3–5 degrees less than perpendicular to the axis of the hanger body, and wherein the plurality of arms include a plurality of hang locations, the plurality of hang locations comprising holes in the plurality of arms.

37. A hanger, comprising:

a hanger body having an attached hanging structure;

a plurality of arms attached to the body; and at least one securing mechanism for securing the plurality of arms in a first position relative to the hanger body;

wherein the plurality of arms are each moveable from the first position to a second position, such that the arms are fixably stopped in the second position, wherein each of the plurality of arms includes a plurality of hang locations for fixedly holding conventional hangers, wherein the hanger body has an axis, wherein the second position is about 3–5 degrees less than perpendicular to the axis of the hanger body, and wherein each hanger further comprises at least one C-shaped accessory holder.

38. A hanger, comprising:

a hanger body having an attached hanging structure;

a plurality of arms attached to the body;

at least one securing mechanism for securing the plurality of arms in a first position relative to the hanger body; and at least one attachment point for attaching a second hanger to the hanger, such that a plurality of hangers is formable into a chain of hangers;

wherein the plurality of arms are each moveable from the first position to a second position, such that the arms are fixably stopped in the second position, wherein each of the plurality of arms includes a plurality of hang locations for fixedly holding conventional hangers, wherein the hanger body has an axis, wherein the second position is about 3–5 degrees less than perpendicular to the axis of the hanger body, and wherein the plurality of arms include a plurality of hang locations, the plurality of hang locations comprising holes in the plurality of arms.

39. A hangers, comprising:

a hanger body having an attached hanging structure;

a plurality of arms attached to the body;

at least one securing mechanism for securing the plurality of arms in a first position relative to the hanger body; and at least one attachment point for attaching a second hanger to the hanger, such that a plurality of hangers is formable into a chain of hangers;

wherein the plurality of arms are each moveable from the first position to a second position, such that the arms are fixably stopped in the second position, wherein each of the plurality of arms includes a plurality of hang locations for fixedly holding conventional hangers, wherein the hanger body has an axis, wherein the second position is about 3–5 degrees less than perpendicular to the axis of the hanger body, and wherein each hanger further comprises at least one C-shaped accessory holder.

40. The hanger of claim 39, wherein the plurality of arms include a plurality of hang locations, the plurality of hang locations comprising holes in the plurality of arms.

41. A hanger, comprising:

a hanger body having an attached hanging structure;

a plurality of arms attached to the body;

at least one securing mechanism for securing the plurality of arms in a first position relative to the hanger body; and at least one accessory holder attachable to the hanger;

wherein the plurality of arms are each moveable from the first position to a second position, such that the arms are fixably stopped in the second position, wherein at least one accessory holder comprises a C-shaped holder, and wherein the plurality of arms include a plurality of hang locations, the plurality of hang locations comprising holes in the plurality of arms.

42. The hanger of claim 11, wherein the plurality of arms include a plurality of hang locations, the plurality of hang locations comprising holes in the plurality of arms.

43. The hanger of claim 11, wherein the plurality of arms include a plurality of hang locations, the plurality of hang locations comprising holes in the plurality of arms, and wherein each hanger further comprises at least one C-shaped accessory holder.

44. A hanger, comprising:

a hanger body having an attached hanging structure;

a plurality of arms attached to the body;

at least one securing mechanism for securing the plurality of arms in a first position relative to the hanger body; and at least one accessory holder attachable to the hanger;

wherein the plurality of arms are each moveable from the first position to a second position, such that the arms are fixably stopped in the second position, wherein at least one accessory holder is pivotally attached to the hanger body, and wherein the plurality of arms include a plurality of hang locations, the plurality of hang locations comprising holes in the plurality of arms.

45. A hanger, comprising:

a hanger body having an attached hanging structure;

a plurality of arms attached to the body;

at least one securing mechanism for securing the plurality of arms in a first position relative to the hanger body; and at least one accessory holder attachable to the hanger;

wherein the plurality of arms are each moveable from the first position to a second position, such that the arms are fixably stopped in the second position, wherein at least one accessory holder is pivotally attached to the hanger body, and wherein each hanger further comprises at least one C-shaped accessory holder.

46. A hanger, comprising:

a hanger body having an attached hanging structure;

a plurality of arms attached to the body;

at least one securing mechanism for securing the plurality of arms in a first position relative to the hanger body;

at least one accessory holder attachable to the hanger; and at least one attachment point for attaching a second hanger to the hangers, such that a plurality of hangers is formable into a chain of hangers;

wherein the plurality of arms are each moveable from the first position to a second position, such that the arms are fixably stopped in the second position, wherein at least one accessory holder is pivotally attached to the hanger body, and wherein the plurality of arms include a plurality of hang locations, the plurality of hang locations comprising holes in the plurality of arms.

47. A hanger, comprising:

a hanger body having an attached hanging structure;

a plurality of arms attached to the body;

at least one securing mechanism for securing the plurality of arms in a first position relative to the hanger body;

at least one accessory holder attachable to the hanger; and at least one attachment point for attaching a second hanger to the hanger, such that a plurality of hangers is formable into a chain of hangers;

wherein the plurality of arms are each moveable from the first position to a second position, such that the arms are fixably stopped in the second position, wherein at least one accessory holder is pivotally attached to the hanger body, and wherein each hanger further comprises at least one C-shaped accessory holder.

48. The hanger of claim 46, wherein each hanger further comprises at least one C-shaped accessory holder.

49. A hangers, comprising:

a hanger body having an attached hanging structure;

plurality of arms attached to the body;

at least one securing mechanism for securing the plurality of arms in a first position relative to the hanger body;

at least one accessory holder attachable to the hanger; and at least one cuff for fixing the accessory holder to the hanger;

wherein the plurality of arms are each moveable from the first position to a second position, such that the arms are fixably stopped in the second position, and wherein the plurality of arms include a plurality of hang locations, the plurality of hang locations comprising holes in the plurality of arms.

50. A hanger, comprising:

a hanger body having an attached hanging structure;

a plurality of arms attached to the body;

at least one securing mechanism for securing the plurality of arms in a first position relative to the hanger body;

at least one accessory holder attachable to the hanger; and at least one cuff for fixing the accessory holder to the hanger;

wherein the plurality of arms are each moveable from the first position to a second position, such that the arms are fixably stopped in the second position, and wherein each hanger further comprises at least one C-shaped accessory holder.

51. A hanger, comprising:

a hanger body having an attached hanging structure;

a plurality of arms attached to the body;

at least one securing mechanism for securing the plurality of arms in a first position relative to the hanger body;

at least one accessory holder attachable to the hanger;

at least one cuff for fixing the accessory holder to the hanger; and at least one attachment point for attaching a second hanger to the hanger, such that a plurality of hangers is formable into a chain of hangers;

wherein the plurality of arms are each moveable from the first position to a second position, such that the arms are fixably stopped in the second position, and wherein the plurality of arms include a plurality of hang locations, the plurality of hang locations comprising holes in the plurality of arms.

52. A hanger, comprising:

a hanger body having an attached hanging structure;

a plurality of arms attached to the body;

at least one securing mechanism for securing the plurality of arms in a first position relative to the hanger body;

at least one accessory holder attachable to the hanger;

at least one cuff for fixing the accessory holder to the hanger; and at least one attachment point for attaching a second hanger to the hanger, such that a plurality of hangers is formable into a chain of hangers;

wherein the plurality of arms are each moveable from the first position to a second position, such that the arms are fixably stopped in the second position, and wherein each hanger further comprises at least one C-shaped accessory holder.

53. The hanger of claim 51, wherein each hanger further comprises at least one C-shaped accessory holder.

54. A system for clothing organization, comprising:

at least two hangers, each hanger comprising:

a hanger body having an attached hanging structure;

a plurality of arms attached to the body;

at least one securing mechanism for securing the plurality of arms in a first position relative to the hanger body; and at least one attachment point for attaching a second hanger to the hanger such that a plurality of hangers is formable into a chain of hangers;

wherein the plurality of arms are each moveable from the first position to a second position, such that the arms are fixably stopped in the second position, and wherein the plurality of arms include a plurality of hang locations, the plurality of hang locations comprising holes in the plurality of arms;

wherein the at least two hangers include at least a first hanger and at least a second hanger, the first hanger hangable from a hanger holder and the second hanger hangable to the first hanger at the at least one attachment point, such that a chain of hangers forms.

55. A system for clothing organization, comprising:

at least two hangers, each hanger comprising:

a hanger body having an attached hanging structure;

a plurality of arms attached to the body;

at least one securing mechanism for securing the plurality of arms in a first position relative to the hanger body;

at least one attachment point for attaching a second hanger to the hanger such that a plurality of hangers is formable into a chain of hangers; and at least one C-shaped accessory holder;

wherein the plurality of arms are each moveable from the first position to a second position, such that the arms are fixably stopped in the second position;

wherein the at least two hangers includes at least a first hanger and at least a second hanger, the first hanger hangable from a hanger holder and the second hanger hangable to the first hanger at the at least one attachment point, such that a chain of hangers forms.

56. The system of claim 54, wherein each hanger further comprises at least one C-shaped accessory holder.

57. A method of hanging clothes, comprising:

providing a hanger, the hanger including a hanger body having an attached hanging structure; a plurality of arms attached to the body; and at least one securing mechanism for securing the plurality of arms in a first position relative to the hanger body, the plurality of arms having a secured and an unsecured position; wherein the plurality of arms are each movable from the first position to a second position such that the arms are fixably stopped in the second position;

hanging at least one conventional hanger on at least one arm while the arm is in the second position;

pivoting the at least one arm upon which hangs at least one conventional hanger from the second position to the first position; and latching the at least one arm upon which hangs at least one conventional hanger in the first position.

58. A hanger, comprising:

a hanger body having an attached hanging structure, a plurality of arms attached to the body; and a plurality of securing mechanisms for securing the plurality of arms in a first position relative to the hanger body, wherein each securing mechanism comprises a latch, wherein each latch has a latched position and an unlatched position, and wherein each latch is biased in the latched position by a spring mechanism;

wherein the plurality of arms are each moveable from the first position to a second position such that the arms are fixably stopped in the second position, wherein each of the plurality of arms includes a plurality of hang locations for fixedly holding conventional hangers, and wherein the plurality of arms include a plurality of hang locations, the plurality of hang locations comprising holes in the plurality of arms.

59. A hanger, comprising:

a hanger body having an attached hanging structure;

a plurality of arms attached to the body; and a plurality of securing mechanisms for securing the plurality of arms in a first position relative to the hanger body, wherein each securing mechanism comprises a latch, wherein each latch has a latched position and an unlatched position, and wherein each latch is biased in the latched position by a spring mechanism;

wherein the plurality of arms are each moveable from the first position to a second position, such that the arms are fixably stopped in the second position, wherein each of the plurality of arms includes a plurality of hang locations for fixedly holding conventional hangers, and wherein each hanger further comprises at least one C-shaped accessory holder.

60. The hanger of claim 2, wherein the plurality of arms include a plurality of hang locations, the plurality of hang locations comprising holes in the plurality of arms.

61. The hanger of claim 2, wherein each hanger further comprises at least one C-shaped accessory holder.

62. The hanger of claim 10, further comprising at least one attachment point for attaching a second hanger to the hanger, such that a plurality of hangers is formable into a chain of hangers.

63. A hanger, comprising:

a hanger body having an attached hanging structure;

a plurality of arms attached to the body; and a plurality of securing mechanisms for securing the plurality of arms in a first position relative to the hanger body;

wherein the plurality of arms are each moveable from the first position to a second position such that the arms are fixably stopped in the second position, wherein each of the plurality of arms includes a plurality of hang locations for fixedly holding conventional hangers, wherein the hanging structure comprises a hook, and wherein the plurality of arms include a plurality of hang locations, the plurality of hang locations comprising holes in the plurality of arms.

64. A hanger, comprising:

a hanger body having an attached hanging structure;

a plurality of arms attached to the body;

a plurality of securing mechanisms for securing the plurality of arms in a first position relative to the hanger body; and at least one C-shaped accessory holder;

wherein the plurality of arms are each moveable from the first position to a second position such that the arms are fixable stopped in the second position, wherein each of the plurality of arms includes a plurality of hang locations for fixedly holding conventional hangers, and wherein the hanging structure comprises a hook.

65. A hanger, comprising:

a hanger body having an attached hanging structure, wherein the hanging structure comprises a hook;

a plurality of arms attached to the body;

a plurality of securing mechanisms for securing the plurality of arms in a first position relative to the hanger body; and at least one attachment point for attaching a second hanger to the hanger, such that a plurality of hangers is formable into a chain of hangers;

wherein the plurality of alms are each moveable from the first position to a second position such that the arms are fixably stopped in the second position, wherein each of the plurality of arms includes a plurality of hang locations for fixedly holding conventional hangers, and wherein the plurality of arms include a plurality of hang locations, the plurality of hang locations comprising holes in the plurality of arms.

66. A hanger, comprising:

a hanger body having an attached hanging structure, wherein the hanging structure comprises a hook;

a plurality of arms attached to the body;

a plurality of securing mechanisms for securing the plurality of arms in a first position relative to the hanger body;

at least one attachment point for attaching a second hanger to the hanger, such that a plurality of hangers is formable into a chain of hangers; and at least one C-shaped accessory holders wherein the plurality of arms are each moveable from the first position to a second position such that the arms are fixably stopped in the second position, and wherein each of the plurality of arms includes a plurality of hang locations for fixedly holding conventional hangers.

* * * * *